US007587878B2

(12) United States Patent
Kim

(10) Patent No.: US 7,587,878 B2
(45) Date of Patent: Sep. 15, 2009

(54) TABLET DISTRIBUTION APPARATUS FOR AUXILIARY TRAYS AND DRIVING METHOD THEREOF

(75) Inventor: Jun-Ho Kim, Suseong-gu (KR)

(73) Assignee: JVM Co., Ltd., Daegu (KR)

( * ) Notice: Subject to any disclaimer, the term of this patent is extended or adjusted under 35 U.S.C. 154(b) by 0 days.

(21) Appl. No.: 12/045,185

(22) Filed: Mar. 10, 2008

(65) Prior Publication Data

US 2009/0188937 A1 Jul. 30, 2009

(30) Foreign Application Priority Data

Jan. 25, 2008 (KR) ..... 10-2008-0008198

(51) Int. Cl.
*B65B 5/06* (2006.01)

(52) U.S. Cl. ..... 53/246; 53/51; 53/474

(58) Field of Classification Search ..... 53/51, 53/55, 235, 237, 244, 245, 246, 390, 473, 53/474

See application file for complete search history.

(56) References Cited

U.S. PATENT DOCUMENTS 3,347,016 A * 10/1967 Silverman ..... 53/246
3,897,216 A * 7/1975 Jones ..... 422/104
4,446,672 A * 5/1984 Raudat ..... 53/246
4,901,865 A * 2/1990 Staples ..... 53/390
5,329,749 A * 7/1994 Yamamoto et al. ..... 53/246
5,502,944 A * 4/1996 Kraft et al. ..... 53/55
5,737,902 A * 4/1998 Aylward ..... 53/246
6,761,010 B1 * 7/2004 Gibson ..... 53/246
2007/0296598 A1 * 12/2007 Kim ..... 340/572.8

FOREIGN PATENT DOCUMENTS

KR 20-0250064 9/2001

* cited by examiner

*Primary Examiner*—Louis K Huynh
(74) *Attorney, Agent, or Firm*—Oblon, Spivak, McClelland, Maier & Neustadt, P.C.

(57) ABSTRACT

The tablet distribution apparatus includes an apparatus body having a pass-through channel through which an auxiliary tray is inserted into the pass-through channel, a distribution board mounted at the top of the apparatus body such that the distribution board vertically communicates with the pass-through channel, the distribution board having distribution through-holes of the same size and number as tablet receiving grooves of the auxiliary tray, each distribution through-hole being provided at the inside thereof with a lamp mounted therein, a display window mounted at the top of the apparatus body, and a control unit mounted at the apparatus body for selectively lighting the lamps depending upon the number of medicine packs to be prepared by patients according to the information of preparation inputted to a server computer.

9 Claims, 7 Drawing Sheets

TABLET DISTRIBUTION APPARATUS FOR AUXILIARY TRAYS AND DRIVING METHOD THEREOF

BACKGROUND OF THE INVENTION

1. Field of the Invention

The present invention relates to a tablet distribution apparatus for auxiliary trays, enabling a pharmacist to more easily and accurately distribute tablets in the auxiliary tray by patients, and a driving method thereof.

2. Description of the Related Art

Generally, an automatic medicine packing machine is constructed in a structure in which a user manually distributes tablets in a main tray, the tablets distributed in the main tray are thrown into a tablet transfer and discharge unit at one time such that the tablets are packed in packing papers for each dose in a sealed state, and then the user manually distributes tablets in the empty main tray. Consequently, the medicine packing process is temporarily interrupted, while the user distributes the tablets in the empty main tray, with the result that the medicine packing process cannot be rapidly carried out.

In order to solve the above-mentioned problem caused from the conventional automatic medicine packing machine, there has been proposed a 'manual distribution tray of automatic medicine distributing machine', which has been filed in the name of the applicant of the present application and granted (Korean Utility Model Registration No. 250064, registration date: Sep. 28, 2001). The structure of the proposed technology is illustrated in FIG. 7.

An automatic medicine distributing machine is constructed in a structure in which a main tray 200, which is operated by an insertion and separation switch (not shown), is mounted at the front of a machine body 100 of the automatic medicine distributing machine such that the main tray 200 is withdrawn from the machine body 100, and an auxiliary tray 300 is disposed above the main tray 200. The coupling between the main tray 200 and the auxiliary tray 300 is achieved by fitting insertion protrusions 301 formed at the bottom of the auxiliary tray 300 into insertion grooves 201 formed at the main tray 200.

However, this conventional technology has the following problems.

A pharmacist manually distributes tablets in the auxiliary tray while the pharmacist sorts the kinds of medicine and the number of medicine packs by patients, with the result that the incorrect distribution of the tablets frequently occurs.

As the pharmacist's incorrect distribution of the tablets by patients in the auxiliary tray frequently occurs, the distribution of the tablets is complicated, and time necessary for the distribution of the tablets increases.

SUMMARY OF THE INVENTION

Therefore, the present invention has been made in view of the above problems, and it is an object of the present invention to provide a tablet distribution apparatus for auxiliary trays and a driving method thereof that is capable of enabling a pharmacist to more easily and accurately distribute tablets in an auxiliary tray by patients.

It is another object of the present invention to provide a tablet distribution apparatus for auxiliary trays and a driving method thereof that is capable of detecting how many times tablets have been thrown into the auxiliary tray, thereby accurately and rapidly distributing the tablets by patients in regular sequence.

It is another object of the present invention to provide a tablet distribution apparatus for auxiliary trays and a driving method thereof that is capable of automatically transferring the auxiliary tray such that the auxiliary tray can be located correctly below a distribution board, thereby smoothly achieving the discharge of the auxiliary tray.

It is a further object of the present invention to provide a tablet distribution apparatus for auxiliary trays and a driving method thereof that is capable of reading an information storage medium, such as a barcode or a radio frequency identification (RFID) tag provided at the auxiliary tray, thereby easily recognizing the information of the auxiliary tray and smoothly achieving the management of the auxiliary tray after the distribution of the tablets is completed.

In accordance with one aspect of the present invention, the above and other objects can be accomplished by the provision of a tablet distribution apparatus for auxiliary trays including an apparatus body having a pass-through channel formed through the apparatus body from the front to the rear of the apparatus body such that an auxiliary tray, in which tablets will be arranged, is inserted into the pass-through channel, a distribution board mounted at the top of the apparatus body such that the distribution board vertically communicates with the pass-through channel, the distribution board having distribution through-holes of the same size and number as tablet receiving grooves of the auxiliary tray, each distribution through-hole being provided at the inside thereof with a lamp mounted therein in such a manner that the lamps in the respective distribution through-holes can be selectively lit, a display window mounted at the top of the apparatus body, and a control unit mounted at the apparatus body for selectively lighting the lamps depending upon the number of medicine packs to be prepared by patients according to the information of preparation inputted to a server computer and displaying the information of medicines to be prepared by patients and the number of medicine packs on the display window.

Preferably, the tablet distribution apparatus further includes a tablet throw-in detection unit mounted inside the pass-through channel below the distribution board for detecting whether tablets have been thrown into the auxiliary tray through the distribution through-holes and inputting the result of the detection to the control unit.

Preferably, the tablet throw-in detection unit includes a light emitting part mounted at the bottom of one side of the distribution board, and a light receiving part mounted at the bottom of the other side of the distribution board such that light receiving part corresponds to the light emitting part.

Preferably, the tablet distribution apparatus further includes a tray transfer unit mounted inside the pass-through channel for automatically transferring the auxiliary tray, inserted into the pass-through channel from the front of the apparatus body, along the pass-through channel, under the control of the control unit.

Preferably, the tray transfer unit includes drive rollers mounted in the apparatus body at positions corresponding to opposite ends of the pass-through channel below the pass-through channel, and a conveyor belt configured to run over the drive rollers as an endless track.

Preferably, the tray transfer unit further includes a tray position sensor mounted at the other side of the distribution board for detecting the position of the auxiliary tray to stop the auxiliary tray, transferred by the conveyor belt, at a position corresponding to the distribution board.

Preferably, the tray transfer unit further includes an insertion detecting sensor mounted at the front end of the pass-through channel for detecting the insertion of the auxiliary tray, and a discharge detecting sensor mounted at the rear end of the pass-through channel for detecting the discharge of the auxiliary tray.

Preferably, the tablet distribution apparatus further includes a tray information recognition unit mounted at one side of the apparatus body, such that the tray information recognition unit is connected to the control unit, for recognizing information recorded on an information storage medium of the auxiliary tray and inputting the recognized information to the control unit.

Preferably, the tablet distribution apparatus further includes an auxiliary distribution board having distribution grooves of the same size and number as the distribution through-holes of the distribution board, and the auxiliary distribution board is disposed at the top of the distribution board and is made of a transparent material that can transmit light emitted from the lamps.

In accordance with another aspect of the present invention, there is provided a driving method of a tablet distribution apparatus, including, when the insertion of an auxiliary tray into an apparatus body from the front of the apparatus body is detected, locating the auxiliary tray inside the apparatus body such that the auxiliary tray is placed below the distribution board, when the auxiliary tray is correctly placed below the distribution board, displaying the information of medicines by patients and the number of medicine packs on a display window according to the information of preparation inputted into a server computer, selectively lighting lamps in distribution through-holes of the distribution board depending upon the number of the medicine packs displayed on the display window, detecting how many times tablets have been thrown into the auxiliary tray through the distribution through-holes and, when it is confirmed that the distribution of the tablets depending upon the number of the medicine packs displayed on the display window is completed, putting out the lit lamps in the distribution through-holes, successively performing the step of displaying the number of the medicine packs on the display window and the step of lighting and putting out the lamps in the distribution through-holes by patients, and discharging the auxiliary tray out of the apparatus body from the rear of the apparatus body after the tablets are completely distributed in the auxiliary tray.

Preferably, the driving method further includes, when the auxiliary tray is correctly located under the distribution board, reading the information recorded on an information storage medium of the auxiliary tray, and the step of reading the information recorded on the information storage medium of the auxiliary tray is carried out after the step of locating the auxiliary tray inside the apparatus body such that the auxiliary tray is placed below the distribution board.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

Figure 1:
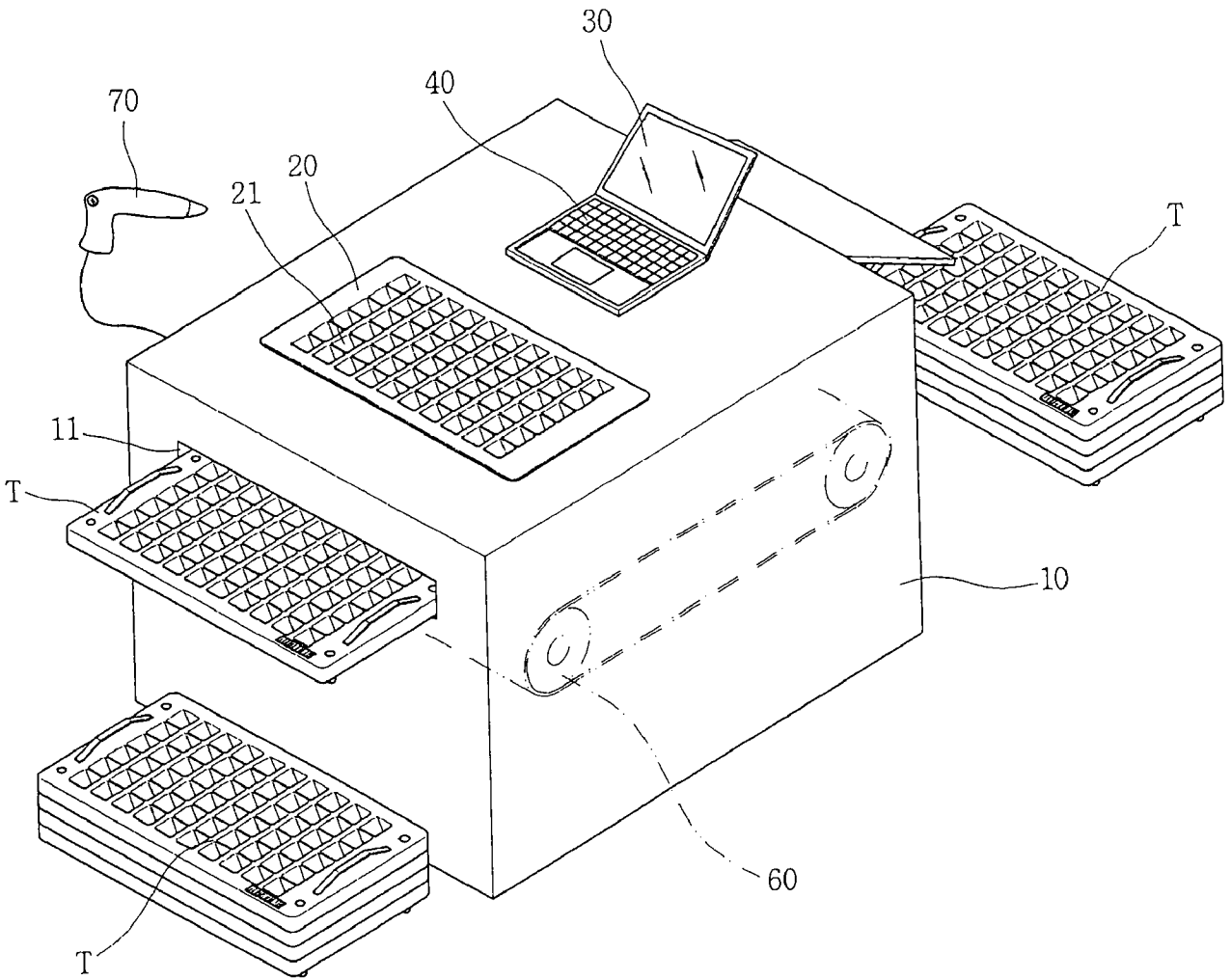
FIG. 1 is a perspective view schematically illustrating a tablet distribution apparatus for auxiliary trays according to an embodiment of the present invention.
Figure 2:
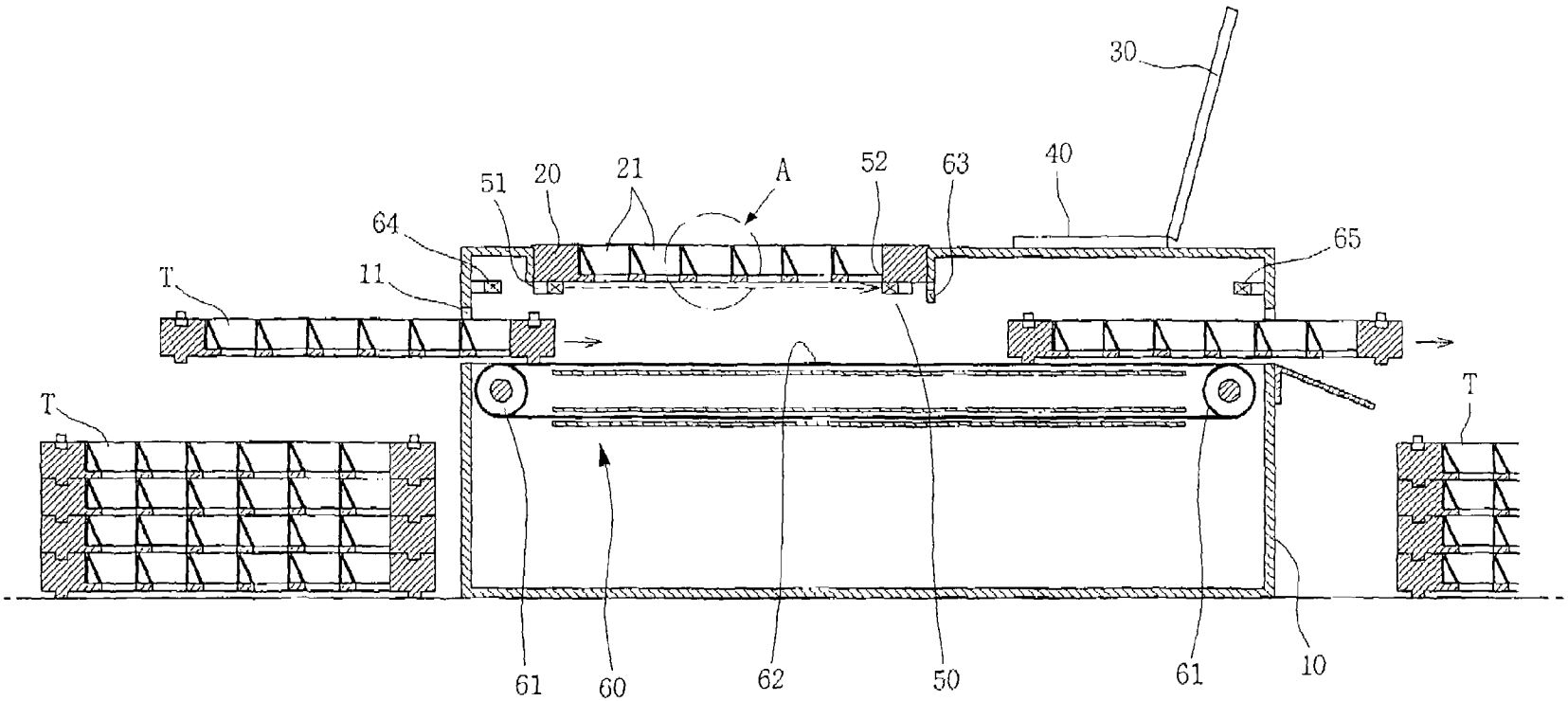
FIG. 2 is a side sectional view schematically illustrating the tablet distribution apparatus for auxiliary trays according to the present invention.
Figure 3:
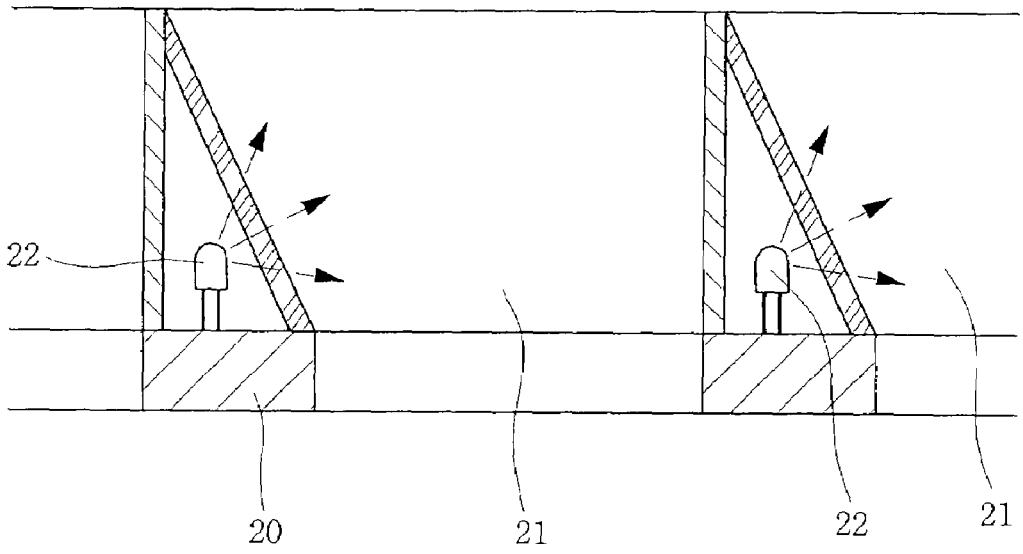
FIG. 3 is an enlarged view illustrating part A of FIG. 2.

FIG. 1 is a perspective view schematically illustrating a tablet distribution apparatus for auxiliary trays according to an embodiment of the present invention, FIG. 2 is a side sectional view schematically illustrating the tablet distribution apparatus for auxiliary trays according to the present invention, and FIG. 3 is an enlarged view illustrating part A of FIG. 2.

As shown in the drawings, the tablet distribution apparatus includes an apparatus body 10, into which an auxiliary tray T is inserted, a distribution board 20 mounted at the top of the apparatus body 10, a display window mounted at the top of the apparatus body 10, and a control unit 40 for controlling the overall operation of the tablet distribution apparatus.

The apparatus body 10 has a pass-through channel 11 horizontally formed through the apparatus body 10 from the front to the rear of the apparatus body 10. The pass-through channel 11 serves as a channel through which an auxiliary tray T, in which tablets will be arranged, is inserted into the apparatus body 10 and discharged out of the apparatus body 10 after tablets are arranged in the auxiliary tray T.

The distribution board 20 is mounted at the top of the apparatus body 10 such that the distribution board 20 vertically communicates with the pass-through channel 11. The distribution board 20 has distribution through-holes 21 of the same size and number as tablet receiving grooves of the auxiliary tray T. A lamp 22 is mounted inside each distribution through-hole 21.

The distribution board 20 serves as a place where a user, e.g. a pharmacist, distributes tablets at the top of the apparatus body 10. Tablets, distributed by the pharmacist, drop through the distribution through-holes 21 of the distribution board 20 and are thrown into the tablet receiving grooves of the auxiliary tray T, which correspond to the respective distribution through-holes 21.

The lamps 22 are lit to lighten the interiors of the respective distribution through-holes 21 such that the user, for example the pharmacist, can accurately and easily recognize the number of the distribution through-holes 21, through which tablets will be distributed. In other words, tablets are distributed only through the distribution through-holes 21 in which the corresponding lamps 22 are lit, whereby the distribution of tablets is accurately achieved depending upon the number of tablets set by patients.

The display window 30 is mounted at the top of the apparatus body 10 for displaying the information of medicines by patients, which is inputted to the control unit 40, to the outside under the control of the control unit 40 such that the pharmacist can easily recognize various kinds of information, such as the information of medicines by patients and the number of medicine packs.

The control unit 40 is mounted at the apparatus body 10. The control unit 40 selectively lights the lamps 22 depending upon the number of medicine packs to be prepared by patients according to the information of preparation inputted to a server computer and, at the same time, controls the display window 30 to display the information of medicines to be prepared by patients and the number of medicine packs thereon.

The tablet distribution apparatus further includes a tablet throw-in detection unit 50 mounted inside the pass-through channel 11 below the distribution board 20. The tablet throw-in detection unit 50 serves to detect whether tablets have been thrown into the auxiliary tray T through the distribution through-holes 21 and input the result of the detection to the control unit 40.

According to the information about how many times the tablets have been thrown in, inputted from the tablet throw-in detection unit 50, the control unit 40 can easily recognize the point of time when the distribution of tablets by patients is completed, and therefore, the distribution of tablets for a next patient is more rapidly achieved.

The tablet throw-in detection unit 50, serving to perform the above-mentioned function, includes a light emitting part 51 mounted at the bottom of one side of the distribution board 20 and a light receiving part 52 mounted at the bottom of the other side of the distribution board 20 such that light receiving part 52 corresponds to the light emitting part 51.

The light emitting part 51 emits light to the light receiving part 52. When a tablet drops, the emission of the light to the light receiving part 52 is instantaneously interrupted, by which the throw-in of the tablet is detected.

The tablet distribution apparatus further includes a tray transfer unit 60 mounted inside the pass-through channel 11. The tray transfer unit 60 serves to automatically transfer the auxiliary tray T, inserted into the pass-through channel 11 from the front of the apparatus body 10, along the pass-through channel 11, under the control of the control unit 40.

As described above, the auxiliary tray T is automatically transferred and discharged by the tray transfer unit 60, under the control of the control unit 40, whereby the operational convenience of the tablet distribution apparatus is improved.

The tray transfer unit 60, serving to perform the above-mentioned function, includes drive rollers 61 mounted in the apparatus body 10 at positions corresponding to opposite ends of the pass-through channel 11 below the pass-through channel 11 and a conveyor belt 62 running over the drive rollers 61 as an endless track.

The drive rollers 61 are provided in a pair. The drive rollers 61 are rotated in the same direction by a motor to move the conveyor belt 62 as the endless track. As the conveyor belt 62 is moved by the drive rollers 61, the auxiliary tray T, inserted into the pass-through channel 11 and placed on the top of the conveyor belt 62, is smoothly transferred to the rear of the apparatus body 10.

The tray transfer unit 60 further includes a tray position sensor 63 mounted at the other side of the distribution board 20 for detecting the position of the auxiliary tray T. The tray position sensor 63 serves to stop the auxiliary tray T, transferred by the conveyor belt 62, at its correct position thereof corresponding to the distribution board 20.

The tray transfer unit 60 further includes an insertion detecting sensor 64 mounted at the front end of the pass-through channel 11 for detecting the insertion of the auxiliary tray T and a discharge detecting sensor 65 mounted at the rear end of the pass-through channel 11 for detecting the discharge of the auxiliary tray T. The insertion detecting sensor 64 and the discharge detecting sensor 65 detects the insertion and discharge of the auxiliary tray T through the pass-through channel 11 of the apparatus body 10 such that the distribution of tablets in a plurality of auxiliary trays T is continuously and accurately achieved.

The tablet distribution apparatus further includes a tray information recognition unit 70 mounted at one side of the apparatus body 10, such that the tray information recognition unit 70 is connected to the control unit 40, for reading information recorded on an information storage medium provided at the auxiliary tray T and inputting the read information to the control unit 40. By the provision of the tray information recognition unit 70, the control unit 40 can easily recognize and store the information about the auxiliary tray T, in which tablets are distributed by patients.

As described above, it is possible to easily confirm patients whose tablets have been distributed in the auxiliary tray T through the recognition of the information about the auxiliary tray T, and therefore, the management of the auxiliary tray T is very easily achieved after the distribution of the tablets is completed.

Although the tray information recognition unit 70 may be directly manipulated by the pharmacist, as described above, the tray information recognition unit 70 may be constructed in an automatic structure in which the tray information recognition unit 70 is mounted below the distribution board 20 for automatically reading information recorded on an information storage medium provided at the top of the auxiliary tray T.

The information storage medium, provided at the auxiliary tray T, may be a barcode attached to the top of the auxiliary tray T or a radio frequency identification (RFID) tag mounted at the auxiliary tray T.

When the information storage medium, provided at the auxiliary tray T, is the barcode, the tray information recognition unit 70 is a barcode reader for recognizing the barcode. On the other hand, when the information storage medium, provided at the auxiliary tray T, is the RFID tag, the tray information recognition unit 70 is an RFID reader for recognizing the RFID.

Figure 4:
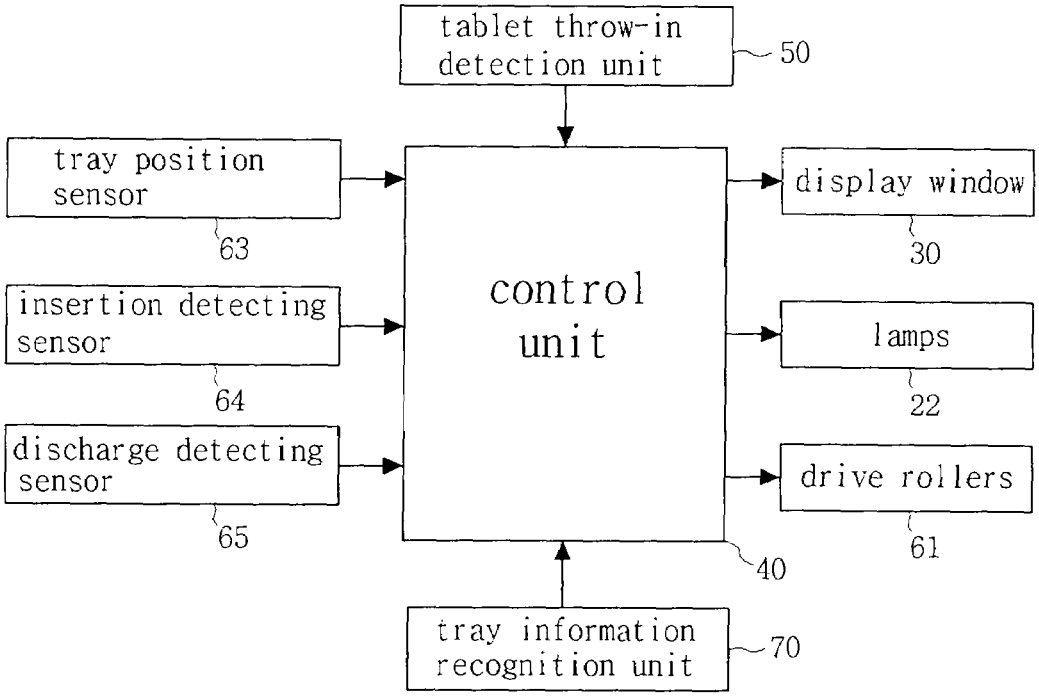
FIG. 4 is a control diagram of the tablet distribution apparatus for auxiliary trays according to the present invention.

FIG. 4 is a control diagram of the tablet distribution apparatus for auxiliary trays according to the present invention.

As shown in FIG. 4, when it is detected by the insertion detecting sensor 64 that an auxiliary tray has been inserted, the control unit 40 operates the drive rollers 61 to accurately transfer the auxiliary tray to a position detectable by the tray position sensor 63.

After the auxiliary tray is transferred to its correct position, the control unit 40 lights the lamps 22 depending upon the number of medicine packs set by patients according to the inputted information of preparation.

At this time, the pharmacist distributes tablets based on the lit lamps 22, and the control unit 40 detects how many times the tablets have been thrown in through the tablet throw-in detection unit 50 to confirm whether the tables have been thrown in depending upon the number of the set medicine packs.

When it is confirmed that the throw-in of the tablets depending upon the number of the set medicine packs is completed, the control unit 40 puts out the lamps 22 and lights the lamps 22 located at the next groove line depending upon the number of medicine packs set for the next patient.

After the distribution of the tablets in the auxiliary tray is completed through the lighting and putting-out operations of the lamps 22, the control unit 40 operates the drive rollers 61 to discharge the auxiliary tray, in which the distribution of the tablets is completed, to the outside.

At this time, the control unit recognizes the discharge of the auxiliary tray through the discharge detecting sensor 65.

While the lamps 22 are lit by the control unit 40, the control unit 40 displays the information of medicines for the patient concerned and the number of the medicine packs to the outside through the display window 30 such that the pharmacist can easily recognize the information of medicines for the patient concerned and the number of the medicine packs.

Also, the control unit 40 stores the information of the auxiliary tray, e.g. the serial number, inputted through the tray information recognition unit 70 and allows a user to easily recognize patients whose tablets have been distributed in the auxiliary tray through the recognition of the serial number of the auxiliary tray.

Figure 5:
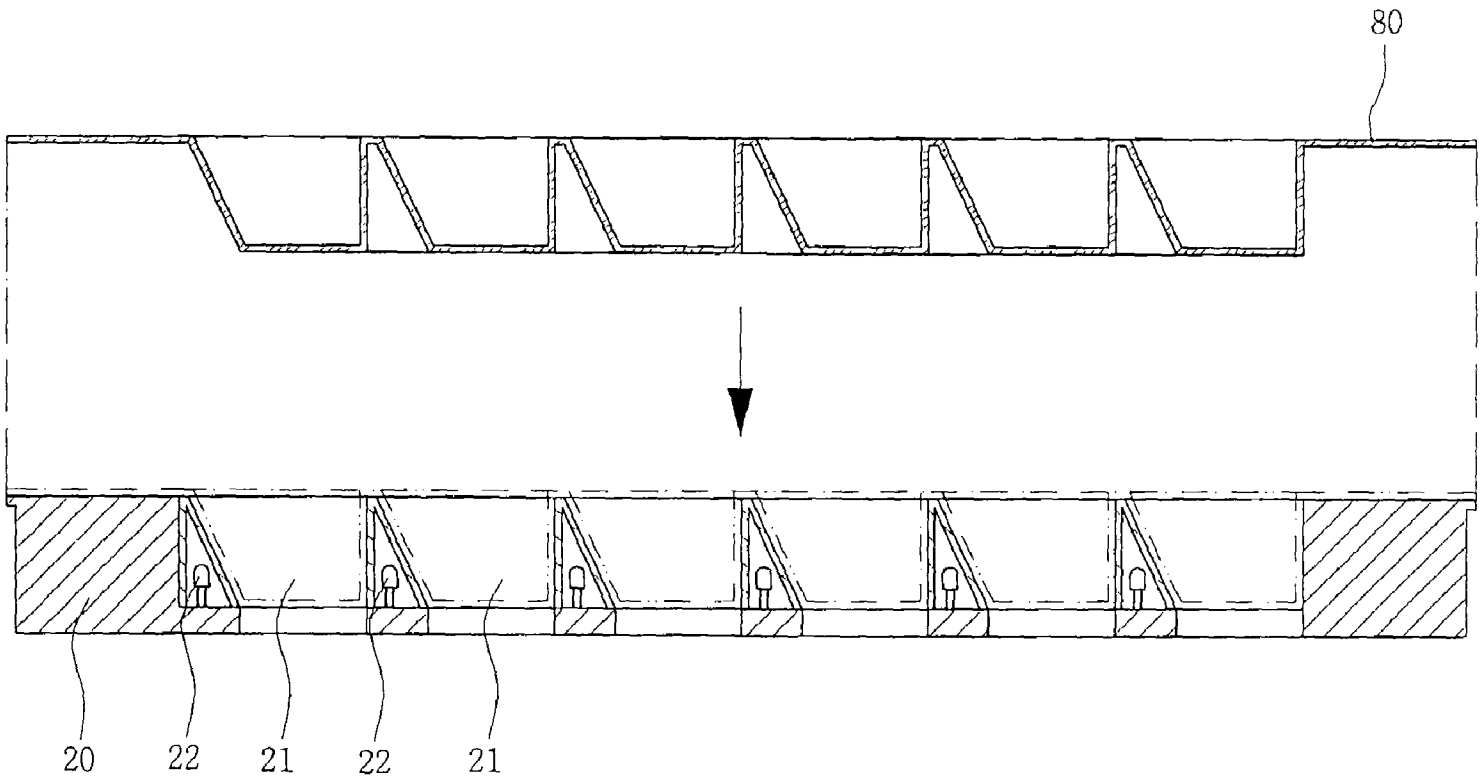
FIG. 5 is an enlarged side sectional view illustrating principal components of a tablet distribution apparatus for auxiliary trays according to another embodiment of the present invention.

FIG. 5 is an enlarged side sectional view illustrating principal components of a tablet distribution apparatus for auxiliary trays according to another embodiment of the present invention.

As shown in FIG. 5, the tablet distribution apparatus further includes an auxiliary distribution board 80 having distribution grooves of the same size and number as the distribution through-holes 21 of the distribution board 20.

The auxiliary distribution board 80 is disposed at the top of the distribution board 20. The auxiliary distribution board 80 is made of a transparent material that can transmit light emitted from the lamps 22 in the respective distribution through-holes 21 of the distribution board 20.

It is possible to recognize the light emitted from the lamps while the auxiliary distribution board 80 is disposed at the top of the distribution board 20. When a small number of tablets are distributed, therefore, it is possible to directly distribute tablets without the insertion of the auxiliary tray.

Figure 6:
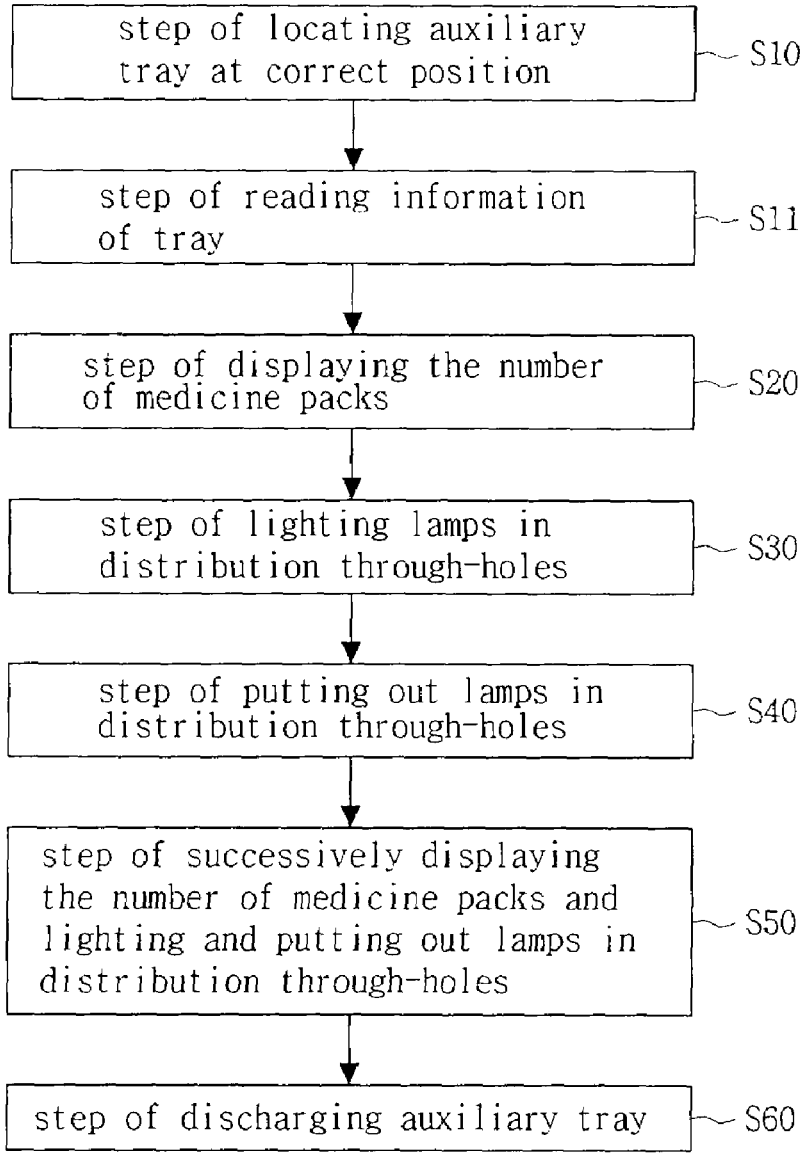
FIG. 6 is a flow chart illustrating a driving method of the tablet distribution apparatus for auxiliary trays according to the present invention.
Figure 7:
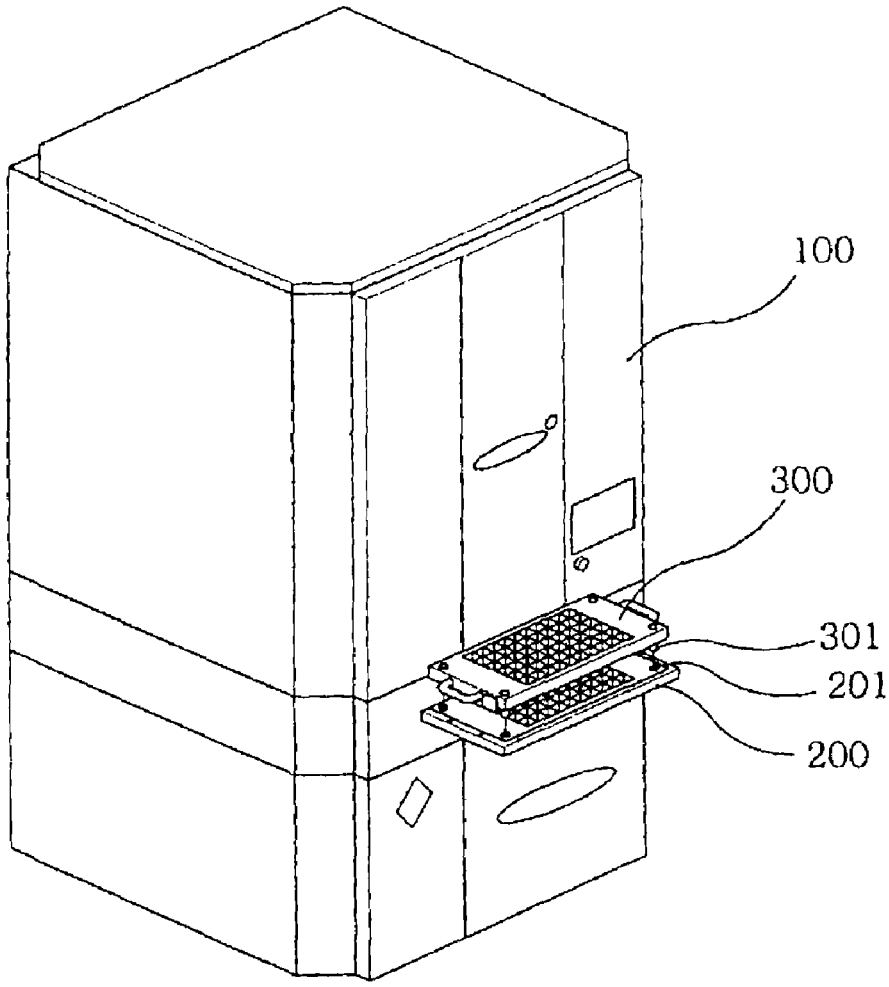
Fig.7 Prior Art
FIG. 7 is a perspective view illustrating a conventional automatic medicine packing machine.

FIG. 6 is a flow chart illustrating a driving method of the tablet distribution apparatus for auxiliary trays according to the present invention.

As shown in FIG. 6, the driving method of the tablet distribution apparatus for auxiliary trays includes a step of locating an auxiliary tray at its correct position (S10), a step of displaying the number of medicine packs to the outside (S20), a step of lighting lamps in distribution through-holes (S30), a step of putting out the lit lamps in the distribution through-holes (S40), a step of successively displaying the number of medicine packs and lighting and putting out the lamps in the distribution through-holes (S50), and a step of discharging the auxiliary tray, in which the distribution is completed (S60). The above-mentioned steps are successively carried out to accurately and easily distribute the tablets in the auxiliary tray.

The step of locating the auxiliary tray at its correct position (S10) is a step of, when the insertion of the auxiliary tray into the apparatus body from the front of the apparatus body is detected, locating the auxiliary tray inside the apparatus body such that the auxiliary tray is placed below the distribution board.

At this step, the auxiliary tray, inserted into the apparatus body from the front of the apparatus body by a pharmacist, is moved inward into the apparatus body such that the auxiliary tray is placed below the distribution board. As a result, tablets drop through the distribution through-holes of the distribution board and are then received in corresponding tablet receiving grooves of the auxiliary tray.

The step of displaying the number of the medicine packs (S20) is a step of, when the auxiliary tray is correctly placed below the distribution board, displaying the information of medicines by patients and the number of medicine packs on the display window according to the information of preparation inputted into the server computer.

At this step, the information of medicines to be distributed by patients and the number of the medicine packs are displayed on the display window such that a user, e.g. a pharmacist, can see the information of medicines to be distributed by patients and the number of the medicine packs and thus accurately perform the distribution of the medicine packs.

The step of lighting the lamps in the distribution through-holes (S30) is a step of lighting the lamps in the respective distribution through-holes depending upon the number of the medicine packs displayed on the display window.

At this step, the lamps in the respective distribution through-holes are lit depending upon the number of the medicine packs displayed on the display window such that a user, e.g. a pharmacist, can accurately recognize positions where tablets will be distributed and the number of medicine packs.

The step of putting out the lit lamps in the distribution through-holes (S40) is a step of detecting how many times the tablets have been thrown into the auxiliary tray through the distribution through-holes and, when it is confirmed that the distribution of the tablets depending upon the number of medicine packs displayed on the display window is completed, putting out the lit lamps in the distribution through-holes.

At this step, when it is confirmed by the pharmacist that the distribution of the tablets is completed after the lamps are lit, the lit lamps are put out, thereby preventing confusion which may be caused when the lamps in the next line of the distribution through-holes are lit.

The step of successively displaying the number of the medicine packs and lighting and putting out the lamps in the distribution through-holes (S50) is a step of successively performing a process for displaying the number of the medicine packs on the display window and a process for lighting and putting out the lamps in the distribution through-holes by patients.

At this step, the above-mentioned processes are successively carried out such that the tablets are completely distributed in the tablet receiving grooves formed at the auxiliary tray.

The step of discharging the auxiliary tray, in which the distribution is completed (S60) is a step of discharging the auxiliary tray out of the apparatus body from the rear of the apparatus body after the tablets are completely distributed in the auxiliary tray.

At this step, after the tablets are completely distributed in the auxiliary tray, the auxiliary tray is discharged out of the apparatus body such that the insertion of another auxiliary tray can be smoothly carried out, and therefore, tables can be successively distributed in a plurality of auxiliary trays.

After the step of locating the auxiliary tray at its correct position (S10), a step of, when the auxiliary tray is correctly located under the distribution board, reading the information recorded on an information storage medium of the auxiliary tray (S11) may be carried out.

At this step, the information of the auxiliary tray, in which the tablets are distributed, e.g. the serial number of the auxiliary tray, is recognized, whereby it is possible to easily recognize patients whose tablets have been distributed in the auxiliary tray after the distribution of the tablets is completed.

The information storage medium, provided at the auxiliary tray, includes a barcode or a RFID tag having its own information of the auxiliary tray, such as the serial number of the auxiliary tray, recorded thereon.

As apparent from the above description, it is possible for a pharmacist to more easily and accurately distribute tablets in the auxiliary tray by patients. Consequently, the present invention has the effect of considerably improving the distribution efficiency.

Also, it is possible to detect how many times the tablets have been thrown into the auxiliary tray. Consequently, the present invention has the effect of accurately and rapidly distributing the tablets by patients in regular sequence.

In addition, it is possible to automatically transfer the auxiliary tray such that the auxiliary tray can be located correctly below the distribution board. Consequently, the present invention has the effect of improving the operational precision of the tablet distribution apparatus and smoothly achieving the discharge of the auxiliary tray.

Furthermore, it is possible to read the information storage medium, such as the barcode or the RFID tag, provided at the auxiliary tray. Consequently, the present invention has the effect of easily recognizing the information of the auxiliary tray and smoothly achieving the management of the auxiliary tray after the distribution of the tablets is completed.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A tablet distribution apparatus for auxiliary trays comprising:

an apparatus body having a pass-through channel formed through the apparatus body from the front to the rear of the apparatus body such that an auxiliary tray, in which tablets will be arranged, is inserted into the pass-through channel;

a distribution board mounted at the top of the apparatus body such that the distribution board vertically communicates with the pass-through channel, the distribution board having distribution through-holes of the same size and number as tablet receiving grooves of the auxiliary tray, each distribution through-hole being provided at the inside thereof with a lamp mounted therein in such a manner that the lamps in the respective distribution through-holes can be selectively lit;

a display window mounted at the top of the apparatus body; and a control unit mounted at the apparatus body for selectively lighting the lamps depending upon the number of medicine packs to be prepared by patients according to the information of preparation inputted to a server computer and displaying the information of medicines to be prepared by patients and the number of medicine packs on the display window.

2. The tablet distribution apparatus according to claim 1, further comprising:

a tablet throw-in detection unit mounted inside the pass-through channel below the distribution board for detecting whether tablets have been thrown into the auxiliary tray through the distribution through-holes and inputting the result of the detection to the control unit.

3. The tablet distribution apparatus according to claim 2, wherein the tablet throw-in detection unit includes a light emitting part mounted at the bottom of one side of the distribution board, and a light receiving part mounted at the bottom of the other side of the distribution board such that light receiving part corresponds to the light emitting part.

4. The tablet distribution apparatus according to claim 1, further comprising:

a tray transfer unit mounted inside the pass-through channel for automatically transferring the auxiliary tray, inserted into the pass-through channel from the front of the apparatus body, along the pass-through channel, under the control of the control unit.

5. The tablet distribution apparatus according to claim 4, wherein the tray transfer unit includes drive rollers mounted in the apparatus body at positions corresponding to opposite ends of the pass-through channel below the pass-through channel, and a conveyor belt configured to run over the drive rollers as an endless track.

6. The tablet distribution apparatus according to claim 5, wherein the tray transfer unit further includes a tray position sensor mounted at the other side of the distribution board for detecting the position of the auxiliary tray to stop the auxiliary tray, transferred by the conveyor belt, at a position corresponding to the distribution board.

7. The tablet distribution apparatus according to claim 6, wherein the tray transfer unit further includes an insertion detecting sensor mounted at the front end of the pass-through channel for detecting the insertion of the auxiliary tray, and a discharge detecting sensor mounted at the rear end of the pass-through channel for detecting the discharge of the auxiliary tray.

8. The tablet distribution apparatus according to claim 1, further comprising:

a tray information recognition unit mounted at one side of the apparatus body, such that the tray information recognition unit is connected to the control unit, for recognizing information recorded on an information storage medium of the auxiliary tray and inputting the recognized information to the control unit.

9. The tablet distribution apparatus according to claim 1, further comprising:

an auxiliary distribution board having distribution grooves of the same size and number as the distribution through-holes of the distribution board, wherein the auxiliary distribution board is disposed at the top of the distribution board and is made of a transparent material that can transmit light emitted from the lamps.

* * * * *